US007762903B2

(12) United States Patent
Bernhardt

(10) Patent No.: US 7,762,903 B2
(45) Date of Patent: Jul. 27, 2010

(54) REMOVABLE INSERT FOR A BOWLING BALL

(76) Inventor: David A. Bernhardt, 2140 - 33 Mile Rd., Romeo, MI (US) 48065

( * ) Notice: Subject to any disclaimer, the term of this patent is extended or adjusted under 35 U.S.C. 154(b) by 186 days.

(21) Appl. No.: 11/678,641

(22) Filed: Feb. 26, 2007

(65) Prior Publication Data

US 2008/0207345 A1 Aug. 28, 2008

(51) Int. Cl.
*A63B 43/00* (2006.01)

(52) U.S. Cl. ..... 473/128; 473/127; 473/129; 473/130; 473/61

(58) Field of Classification Search ..... 473/61, 473/127, 128, 129, 130
See application file for complete search history.

(56) References Cited

U.S. PATENT DOCUMENTS

| | | | | |
|---|---|---|---|---|
| 1,080,307 | A | 12/1913 | Sondheimer | |
| 3,001,793 | A * | 9/1961 | Insetta | 473/130 |
| 3,102,725 | A | 9/1963 | Jarus | |
| 3,861,681 | A * | 1/1975 | Kelsey | 473/130 |
| 3,912,355 | A * | 10/1975 | Curado et al. | 439/546 |
| 4,029,953 | A * | 6/1977 | Natoli | 362/382 |
| 4,247,102 | A | 1/1981 | Seyler | |
| 4,561,654 | A | 12/1985 | Haza | |
| 4,778,178 | A | 10/1988 | Haza | |
| 4,892,308 | A | 1/1990 | Gaunt | |
| 5,118,106 | A | 6/1992 | Goldman | |
| 5,308,061 | A | 5/1994 | Bernhardt | |
| 5,536,212 | A * | 7/1996 | Tryon | 473/129 |
| 5,738,592 | A | 4/1998 | Saunders | |
| 5,795,236 | A | 8/1998 | Alberts et al. | |
| 5,800,276 | A * | 9/1998 | Hill | 473/128 |
| 6,126,553 | A | 10/2000 | Lakusiewicz | |
| 6,280,343 | B1 | 8/2001 | Scheid et al. | |
| 6,830,518 | B2 | 12/2004 | Graskewicz | |
| 7,044,863 | B1 * | 5/2006 | Brewster | 473/129 |
| 7,048,636 | B1 | 5/2006 | Sill | |
| 7,074,130 | B2 | 7/2006 | Haisley | |

FOREIGN PATENT DOCUMENTS

| | | |
|---|---|---|
| DE | 10059948 | 6/2002 |
| EP | 1349024 | 10/2003 |
| WO | WO 03004882 | 5/2003 |
| WO | WO 2006/099100 | 9/2006 |

* cited by examiner

*Primary Examiner*—Gene Kim
*Assistant Examiner*—Joseph B Baldori
(74) *Attorney, Agent, or Firm*—Harness, Dickey & Pierce, P.L.C.

(57) ABSTRACT

A bowling ball thumb insert has a first and second sleeve. The second sleeve is retained in the first sleeve. The first sleeve has a coupling mechanism including a ledge extending radially inward towards the center of the sleeve. A positioning gap is adjacent the ledge. A second sleeve is positioned inside the first sleeve. The second sleeve includes a coupling mechanism. The second sleeve coupling mechanism includes a wing extending radially outward from the outer surface of the second sleeve. The wing passes through the positioning gap. When one of the sleeves is rotated with respect to the other, the sleeves lock together.

16 Claims, 5 Drawing Sheets

REMOVABLE INSERT FOR A BOWLING BALL

FIELD

The present disclosure relates to bowling and, more particularly, to an insert for a bowling ball.

BACKGROUND

The statements in this section merely provide background information related to the present disclosure and may not constitute prior art.

During bowling, it is desirable to have the best feel of the ball when delivering it down the lane. In order to do this, finger inserts have been devised to provide the bowler with maximum feel of the ball in their hand. This is accomplished by providing inserts in the finger as well as in the thumb holes. During bowling, it is not uncommon for a bowler's thumb to swell during play. Thus, it is desirable to have an interchangeable thumb insert which would enable the bowler to adjust the thumb insert for varying conditions during bowling. Also, it is possible to change the thumb insert to accommodate a different bowler with the same ball.

Various types of removable inserts exist in the art. While it appears that the inserts are satisfactory for their intended purpose, those skilled in the art are always striving to improve the state of the art. Accordingly, the present disclosure provides a bowling ball thumb insert which includes an inner and outer sleeve. The outer sleeve is secured into a bowling ball. The inner sleeve is easily positioned into and locked in position on the outer sleeve. The present invention provides mating wings as well as a circumferential locking tab. Also, the disclosure illustrates partial threads on the inner and outer member to mate them with one another.

SUMMARY

According to a first aspect of the disclosure, a bowling ball thumb insert comprises a first sleeve with a cylindrical wall. The cylindrical wall has an outer surface and an inner surface. The sleeve is adapted to fit into a bowling ball where the outer surface is adjacent to and secured with the bowling ball. An inner wall surface receives a second sleeve. The first sleeve has a distal end adapted to be positioned adjacent the bottom of a bore in the bowling ball. Two circumferential ledges extend radially inward from the inner wall surface. The two ledges oppose one another and define at least two gaps. The gaps have unequal circumferential sizes of at least 60° around the circumference of the inner surface. A second sleeve is positioned within the first sleeve. The second sleeve includes a cylindrical wall with an inner and outer surface. The outer surface is adjacent the inner surface of the first sleeve. The second sleeve includes at least two locking wings at a distal end of the second sleeve. The two locking wings extend radially outward from the outer surface. The two locking wings extend circumferentially about the outer surface to position through the gaps so that when the second sleeve is rotated, it mates with the ledges. The wings have different circumferential lengths. The lengths vary circumferentially from 60° to 90°. A stop extends radially inward from the first sleeve inner surface. The stop includes a detent on a circumferential surface. A projecting tab is adjacent each wing to contact the detent to lock the first and second sleeves together. Each of the two ledges has first and second surfaces on planes which are transverse to the longitudinal axis of the outer sleeve.

According to a second aspect of the disclosure, a bowling ball thumb insert comprises a first sleeve with a cylindrical wall. The cylindrical wall has an inner and outer surface. The outer surface is adapted to fit adjacent to and be secured to a bowling ball. The inner wall surface receives a second sleeve. The first sleeve has a distal end adapted to be positioned adjacent a terminus of a bowling ball bore. A ledge extends from the inner wall surface. A stop includes a circumferential detent on the inner wall surface. A second sleeve is positioned within the first sleeve. The second sleeve includes a cylindrical wall with an inner and outer surface. The outer surface is adjacent the inner surface of the first sleeve. The second sleeve includes a ledge at a distal end of the second sleeve. The second ledge mates with the first ledge. A projecting member is adjacent the second ledge to mate with a detent on the first sleeve to lock the first and second sleeves together. The outer sleeve ledge is positioned a desired distance from the distal end. The projecting member on the second sleeve outer surface is adjacent the distal end. The stop, which includes the detent, extends radially inward from the distal end of the first sleeve.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
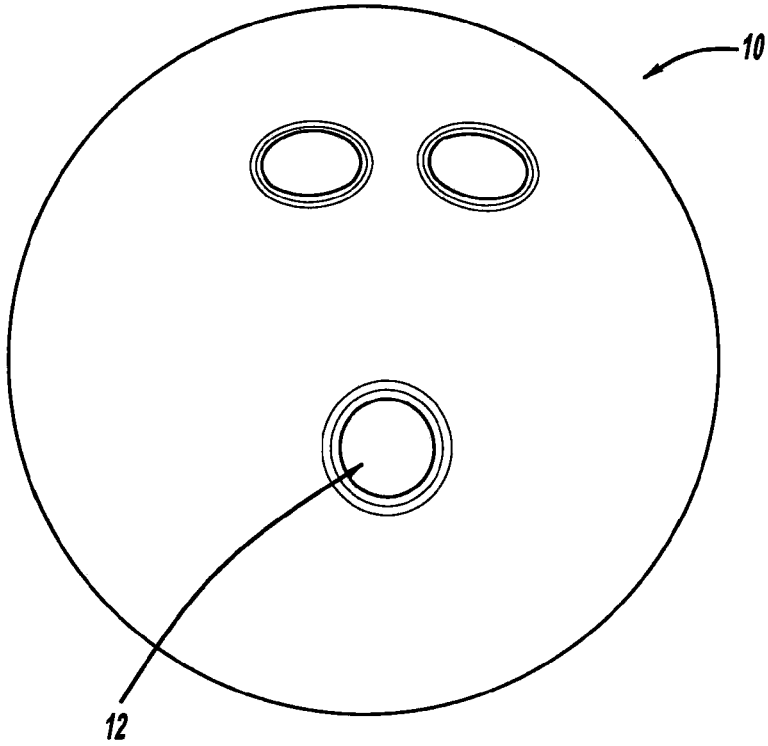
FIG. 1 is a perspective view of a bowling ball including the thumb insert of the present disclosure.
Figure 2:
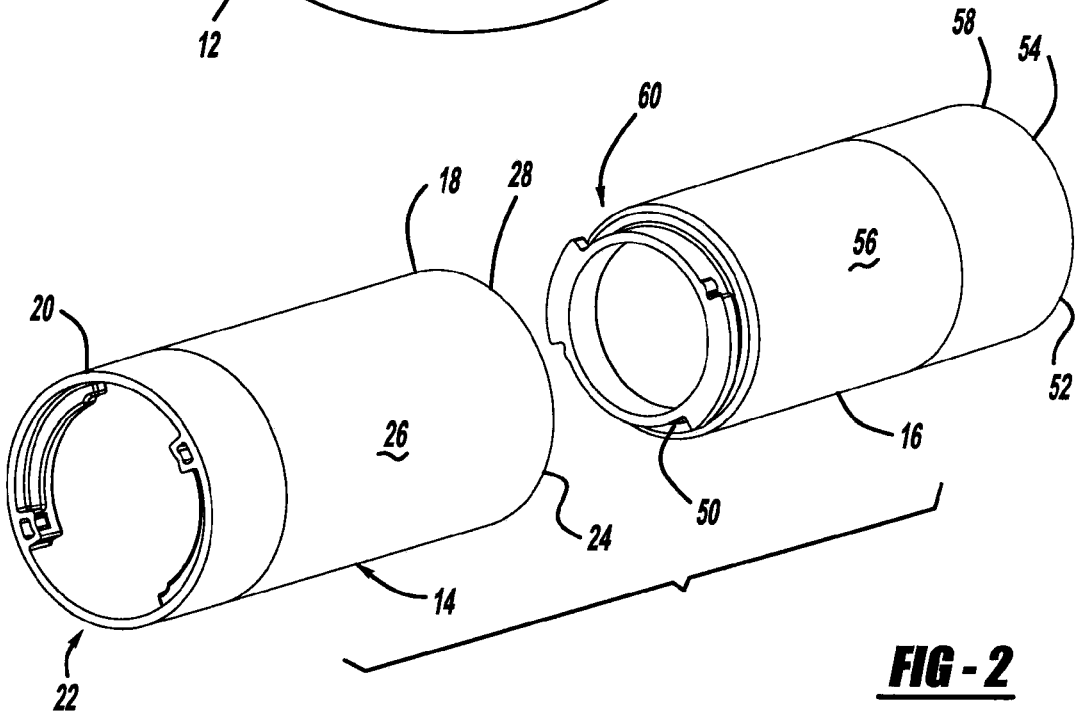
FIG. 2 is an exploded perspective view of the thumb insert of FIG. 1.

Turning to the figures, a bowling ball 10 is illustrated with a thumb insert, which is designated with the reference numeral 12. The thumb insert 12 includes an outer sleeve 14 and an inner sleeve 16, as illustrated in FIG. 2.

The outer sleeve 14 includes a proximal end 18 and a distal end 20. A coupling device 22 is positioned adjacent the distal end 20. The outer sleeve 14 defines a cylindrical wall 24 with an outer surface 26 and an inner surface 28. The outer surface 26 is sized to be positioned adjacent to and secured with the bowling ball 10. The proximal end 18 is positioned substantially flush with the surface of the bowling ball after it is inserted into the bowling ball 10. The distal end 20 is positioned at the terminus or end of the bore in the bowling ball.

Figure 3:
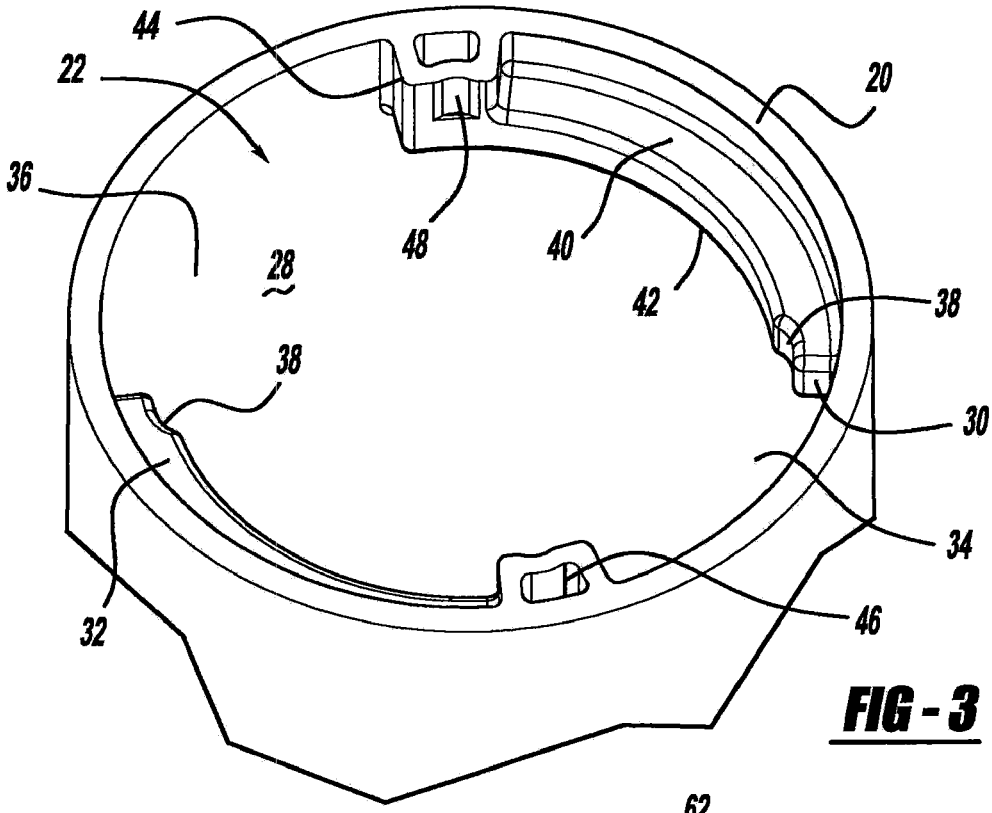
FIG. 3 is a perspective view of the distal end of the outer sleeve of FIG. 2.

Turning to FIG. 3, the coupling mechanism 22 is better illustrated. The coupling mechanism 22 includes a pair of ledges 30 and 32. The ledges 30 and 32 are substantially identical and the discussion will be applied to both. The ledges 30 and 32 are circumferentially positioned about the inner wall 28 of the cylindrical wall 24. The ledges 30 and 32 are separated by gaps 34 and 36. The gaps 34 and 36 are of unequal circumferential length. Generally, the gap 34 is between 60° to 70° and preferably at 65°. The gap 36 is between 80° to 90° and is preferably at 85°. The ledges 30 and 32 are positioned at an offset with respect to a plane dividing the cylindrical wall longitudinally in half to provide for the unequal gap sizes. However, the ledges have substantially equal circumferential length.

The ledges 30 and 32 include a chamfered starting portion 38 which extends circumferentially towards the center of the cylindrical wall. The ledges 30 and 32 are positioned a desired distance from the distal end of the sleeve 14. The ledges 30 and 32 include first and second surfaces 40 and 42 which are substantially planar. The planes of the surfaces 40 and 42 are parallel with one another. Also, the first and second surfaces 40 and 42 of each ledge 30 and 32 are substantially co-planar with one another, respectively.

Blocks 44 and 46 are positioned at the end of the ledges 30 and 32. The blocks 44 and 46 are substantially identical and project radially inward from the inner surface 28 of the cylindrical wall 24. The blocks 44, 46 include a circumferential detent 48 which is recessed radially outward from the center of the outer sleeve 14. The detent 48 receives a member to lock the first and second sleeves 14, 16 together. The blocks 44, 46 extend to the distal end of the sleeve 14. Also, the detents 48 are offset with respect to the surface 40 of the ledges 30 and 32.

The second inner sleeve 16 includes a distal end 50 and a proximal end 52. Also, the second sleeve 16 defines a cylindrical wall 54 which includes outer surface 56 and inner surface 58. The second inner sleeve 16 includes a coupling mechanism 60. The wall 54 is sized to be positioned adjacent the inner surface 28 of the outer sleeve 14. The inner surface 58 of the second sleeve is adapted to receive a thumb of a bowler.

Figure 4:
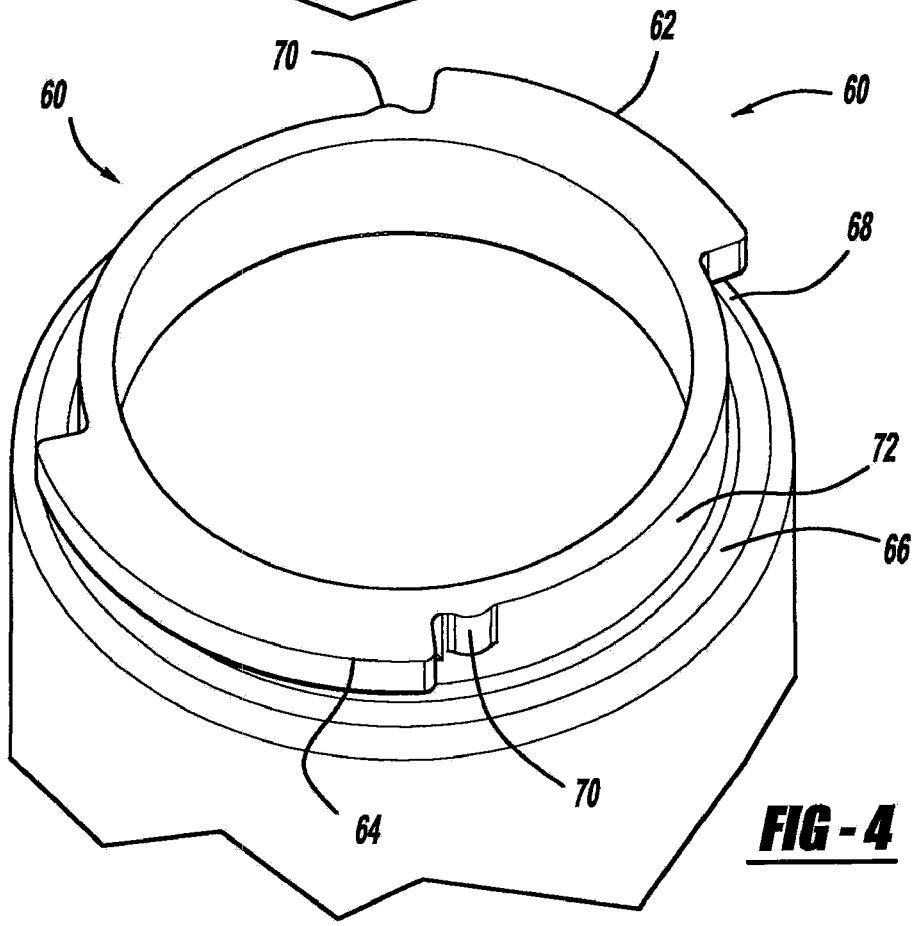
FIG. 4 is a perspective view of the distal end of the inner sleeve of FIG. 2.

Turning to FIG. 4, the coupling mechanism 60 is illustrated. The coupling mechanism 60 includes a pair of wings 62 and 64. The wings 62 and 64 have a circumferential length which is different from one another. The circumferential length of wing 62 varies between 55° to 65° and is preferably 60°. The circumferential length of wing 64 is between 75° to 85° and is preferably 80°. This enables the second sleeve 18 to be uni-directionally positioned in the first sleeve 14 so that proper coupling is achieved.

A circumferential surface 66 is spaced from the wings 62 and 64. The circumferential surface 66 extends radially inward from the inner sleeve wall 54 to provide a channel 68 between the surface 66 and a surface of the wings 62 and 64. The channel 68 receives the ledges 30 and 32 to couple the second sleeve 18 with the first sleeve 14. The wings 62 and 64, other than having a different circumferential length, are substantially identical. The wings 62 and 64 have a substantially constant thickness with their upper and lower surfaces being in planes parallel to one another. Also, the upper and lower surfaces of the wings 62, 64 are coplanar with one another, respectively. A projecting member 70 extends radially outwardly from a cylindrical wall 72. The wall 72 extends along the axis of the sleeve 18 from the circumferential surface 66 forming a step between the two. The projecting member 70 couples with the detent 48 to lock the first and second sleeves together when they are positioned together and rotated with respect to one another.

Figure 5:
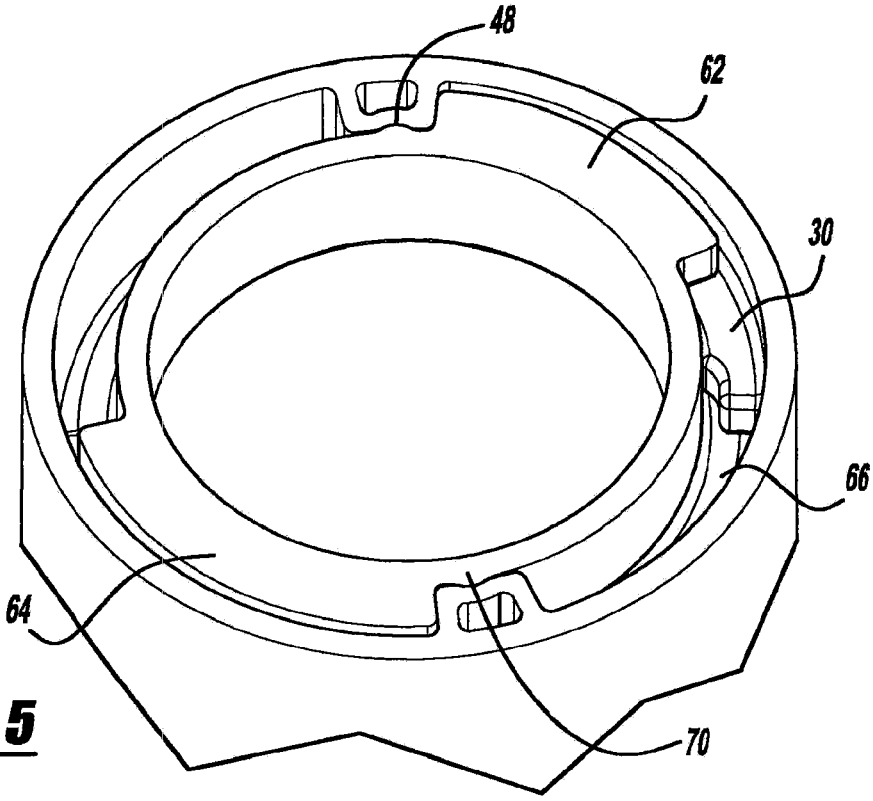
FIG. 5 is a perspective view of the inner and outer sleeves coupled with one another.
Figure 6:
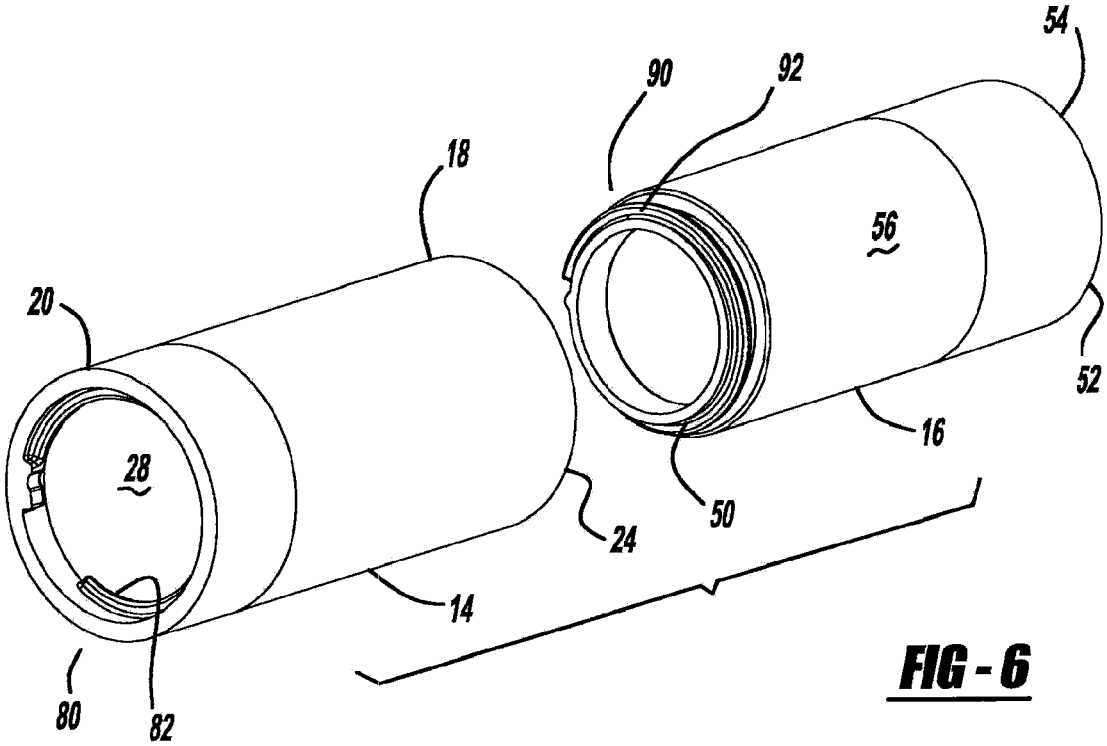
FIG. 6 is an exploded perspective view of a second embodiment of a thumb insert.
Figure 7:
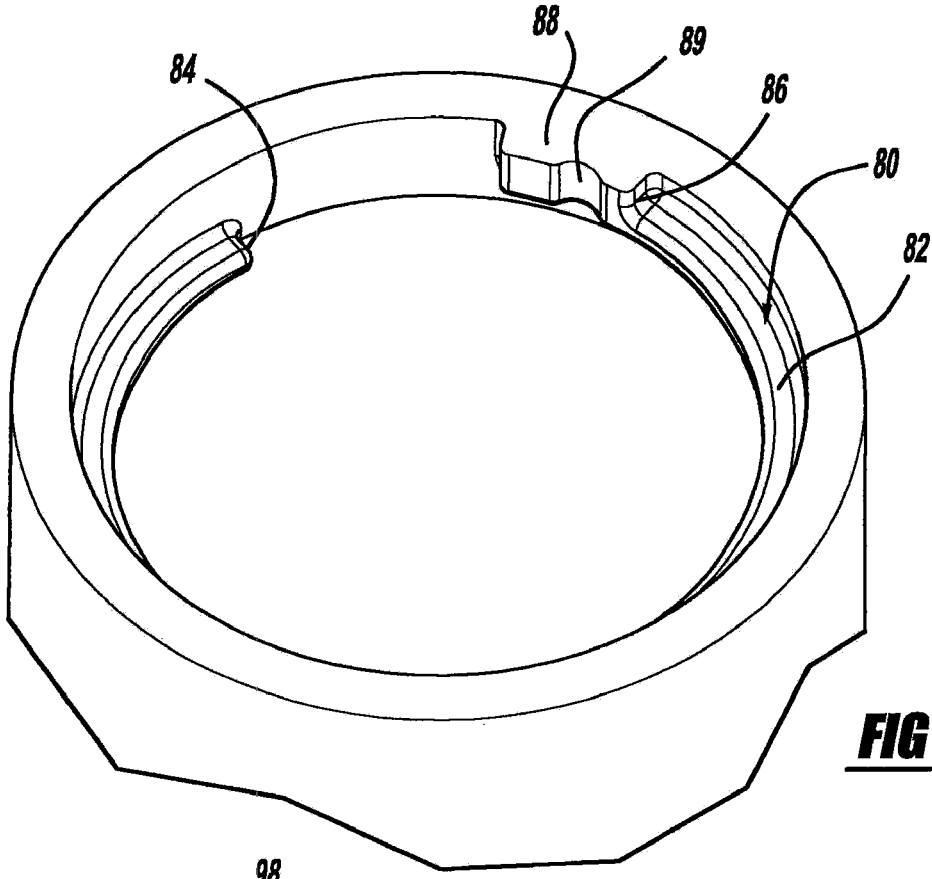
FIG. 7 is a perspective view of the distal end of the outer sleeve of the additional embodiment of FIG. 6.
Figure 8:
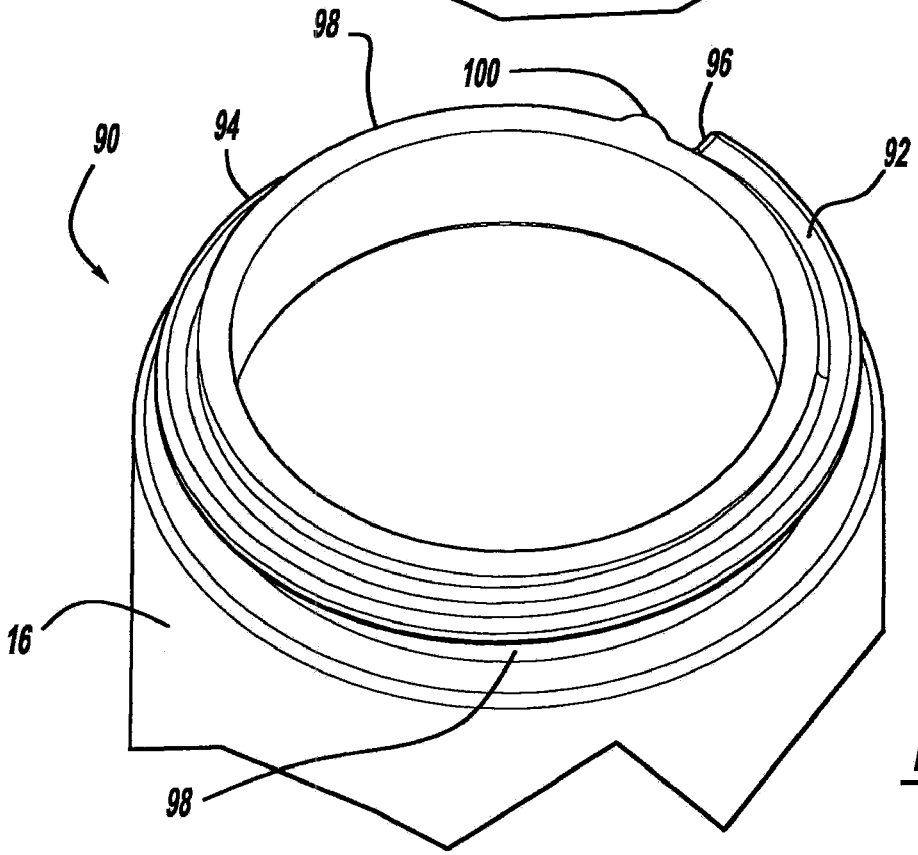
FIG. 8 is the distal end of the inner sleeve of the additional embodiment of FIG. 6.

FIG. 5 illustrates the two coupling mechanisms 22 and 60 coupled with one another. As can be seen, the ledges 30 and 32 are positioned in the channels 68 between the circumferential surface 66 and the wings 62 and 64. Also, the projecting members 70 are in the detents 48. The wings 62 and 64 are at the distal end of the sleeve 18. Also, the projecting members 70 are likewise at the distal end of the second sleeve 18.

Turnings to FIGS. 6-9, an additional embodiment is illustrated. The additional embodiment is substantially the same as that previously discussed; however, the coupling mechanism is different.

The outer sleeve 14 is substantially the same as that previously discussed; however, the coupling mechanism is different. The coupling mechanism 80 includes a ledge 82 which is inclined to provide a partial thread portion. The ledge 82 has a substantially constant thickness and is along a helical path about the periphery of the inner surface. The ledge 82 has a circumferential length of between 280° to 290°. Preferably, the length is 285°. The ends of the ledge 84 and 86 are spaced by a stop portion 88. The stop portion 88 is continuous with the distal portion of the sleeve 14. The stop 86 includes a detent 89 which enhances locking of the two sleeves with one another.

Figure 9:
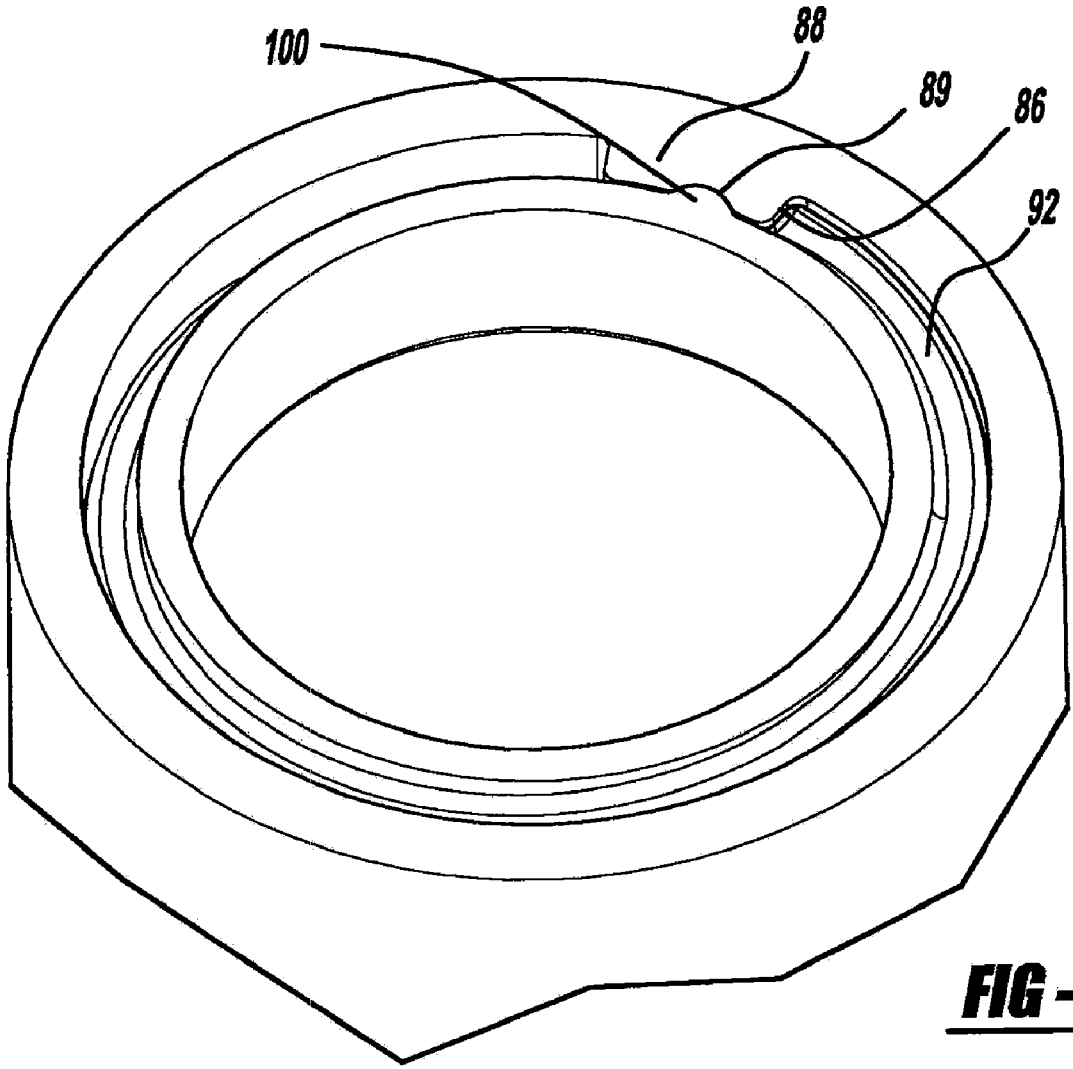
FIG. 9 is a perspective view of the distal ends of FIGS. 6 and 7 coupled with one another.

The second inner sleeve 16 is the same as that previously described except for the coupling mechanism 90. The coupling mechanism 90 includes a ledge 92 which has a substantially constant thickness. The ledge 92 is along a helical path about the outer surface of the wall 70. The ledge 92 has a circumferential length of between 275° to 285°. Preferably, the length is 280°. A gap is formed between the ends 94 and 96 of the ledge 92. The gap 98 has a circumferential length of about 40° to 50° and preferably about 45°. The gap 98 enables positioning of the inner sleeve into the outer sleeve so that the gap mates with the stop portion 86 as seen in FIG. 9. A projecting member 100 is adjacent the end 96 of the ledge 92. The projection member 100 is at the distal end of the inner sleeve 16. The projecting member 100 is inserted into the detent 89 to lock the two sleeves together as seen in FIG. 9.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A bowling ball thumb insert comprising:

a first sleeve with a cylindrical wall having an outer wall surface adapted to fit into a bowling ball and a cylindrical inner wall surface for receiving a second sleeve, said first sleeve having a distal end adapted to be positioned adjacent a bowling ball bore end, two circumferential ledges extending radially inward from said cylindrical inner wall surface, said two ledges opposing one another and defining two gaps;

said two gaps having unequal circumferential sizes and both said gaps having a circumferential length of at least 60° about the circumference of said inner surface;

a second sleeve positioned within said first sleeve, said second sleeve including a cylindrical wall having an outer cylindrical surface adjacent said inner cylindrical surface of said first sleeve; said second sleeve including two locking wings at a distal end of said second sleeve, said two locking wings extending radially outward from said outer surface and having a circumferential length slightly smaller than the gaps, said two locking wings extending circumferentially about said outer surface for positioning through said gaps and for being rotated to mate with said two circumferential ledges;

a stop extending radially inward from said inner cylindrical wall surface adjacent said ledge having a detent, said detent spaced radially inward from said inner cylindrical wall surface; and a projecting member on said second sleeve adjacent said ledge for mating with said detent, said projecting member spaced and separated from said second sleeve ledge and projecting radially outward from said outer cylindrical surface such that said projecting member does not project beyond an outer circumference of said second sleeve ledge.

2. The bowling ball thumb insert of claim 1, further comprising a stop extending radially inward from said first sleeve cylindrical inner surface, said stop including a detent on said cylindrical inner surface.

3. The bowling ball thumb insert of claim 2 further comprising a projecting tab adjacent at least one of said wings for contacting said detent.

4. The bowling ball thumb insert of claim 1, wherein said two ledges are defined by a pair of planar surfaces on planes transverse to a longitudinal axis of said first sleeve.

5. The bowling ball thumb insert of claim 1, wherein one gap circumferential length is between 60° to 70° and the other gap circumferential length is between 80° to 90°.

6. The bowling ball thumb insert of claim 1, further comprises said ledges having first and second surfaces substantially planar with one another.

7. The bowling ball thumb insert of claim 1, wherein a detent is beside the ledge.

8. The bowling ball thumb insert of claim 1, wherein one wing has a circumferential length of between 55° to 65°.

9. The bowling ball thumb insert of claim 1, wherein the second wing has a circumferential length of between 75° to 85°.

10. A bowling ball insert comprising:

a first sleeve with a cylindrical wall having an outer wall surface adapted to fit into a bowling ball and an inner cylindrical wall surface for receiving a second sleeve, said first sleeve having a distal end adapted to be positioned adjacent a bowling ball bore end;

a ledge extending from said inner cylindrical wall surface, a stop extending radially inward from said inner cylindrical wall surface adjacent said ledge having a detent, said detent spaced radially inward from said inner cylindrical wall surface; and a second sleeve positioned within said first sleeve, said second sleeve including a cylindrical wall having an outer cylindrical surface adjacent said inner cylindrical wall surface of said first sleeve, said second sleeve including a ledge at a distal end of said second sleeve for mating with said first sleeve ledge, and a projecting member on said second sleeve adjacent said ledge for mating with said detent, said projecting member spaced and separated from said second sleeve ledge and projecting radially outward from said outer cylindrical surface such that said projecting member does not project beyond an outer circumference of said second sleeve ledge.

11. The bowling ball thumb insert of claim 10, wherein said first sleeve ledge is positioned a desired distance from said distal end.

12. The bowling ball thumb insert of claim 10, wherein said projecting member is on said second sleeve outer surface adjacent its distal end.

13. The bowling ball thumb insert of claim 10, wherein said stop extends radially inward from said distal end.

14. The bowling ball thumb insert of claim 10, wherein said ledge of said outer sleeve outer cylindrical wall has a circumferential length of between 280° to 290°.

15. The bowling ball thumb insert of claim 10, wherein said ledge of said inner sleeve outer cylindrical wall has a circumferential length of between 275° to 285°.

16. The bowling ball thumb insert of claim 10, wherein a gap has a circumferential length of about 45° to 50°.

* * * * *

UNITED STATES PATENT AND TRADEMARK OFFICE

CERTIFICATE OF CORRECTION

PATENT NO. : 7,762,903 B2
APPLICATION NO. : 11/678641
DATED : July 27, 2010
INVENTOR(S) : David A. Bernhardt It is certified that error appears in the above-identified patent and that said Letters Patent is hereby corrected as shown below:

Title Page
(56) References Cited, FOREIGN PATENT DOCUMENTS,

Delete the following heading and listed patents

"FOREIGN PATENT DOCUMENTS

| | | |
|---|---|---|
| DE | 10059948 | 6/2000 |
| EP | 1349024 | 10/2003 |
| WO | WO 03004882 | 5/2003 |
| WO | WO 2006/099100 | 9/2006" |

Column 4
Line 11 "Turnings" should be --Turning--
Line 39 "projection" should be --projecting--

Signed and Sealed this
Twenty-second Day of February, 2011

David J. Kappos

David J. Kappos
*Director of the United States Patent and Trademark Office*